US008375650B2

(12) United States Patent
Gratzer

(10) Patent No.: US 8,375,650 B2
(45) Date of Patent: Feb. 19, 2013

(54) RAPID DEPLOYABLE STRUCTURE FOR REMOTE INSTALLATION

(75) Inventor: Douglas J. Gratzer, Tucson, AZ (US)

(73) Assignee: International Towers, Inc., Tucson, AZ (US)

( * ) Notice: Subject to any disclaimer, the term of this patent is extended or adjusted under 35 U.S.C. 154(b) by 739 days.

(21) Appl. No.: 12/576,983

(22) Filed: Oct. 9, 2009

(65) Prior Publication Data

US 2011/0083394 A1 Apr. 14, 2011

(51) Int. Cl.
*E04G 21/14* (2006.01)
*E04H 12/10* (2006.01)

(52) U.S. Cl. ..... 52/127.1; 52/651.01

(58) Field of Classification Search ..... 52/651.01, 52/651.1, 651.02, 651.04, 651.05, 651.07, 52/40, 127.2, 127.1, 745.2, 745.18; 33/533
See application file for complete search history.

(56) References Cited

U.S. PATENT DOCUMENTS

| | | | | | |
|---|---|---|---|---|---|
| 422,036 | A | * | 2/1890 | Phelps | 52/637 |
| 800,935 | A | * | 10/1905 | Noyes | 52/651.02 |
| 855,138 | A | * | 5/1907 | Soiple | 52/651.02 |
| 933,493 | A | * | 9/1909 | Scholes | 52/651.02 |
| 2,198,955 | A | * | 4/1940 | Taylor | 52/651.02 |
| 6,026,627 | A | * | 2/2000 | Moore | 52/651.02 |
| 6,082,070 | A | * | 7/2000 | Jen | 52/650.3 |

FOREIGN PATENT DOCUMENTS

| | | | | |
|---|---|---|---|---|
| JP | 06257291 | A | * | 9/1994 |
| WO | WO 9105119 | A1 | * | 4/1991 |

* cited by examiner

*Primary Examiner* — Christine T Cajilig
(74) *Attorney, Agent, or Firm* — Quarles & Brady LLP; Michael J. Curley; Gavin Milczarek-Desai

(57) ABSTRACT

A rapidly deployable structure for remote installation and method of constructing same is disclosed. The structure includes a plurality of vertical support columns topped with guiding structures. Each guiding structure has a narrow top and flares toward a comparatively wider bottom end. The structures have horizontal members including apertures that interface with the guiding structures as the horizontal members are lowered into place.

20 Claims, 9 Drawing Sheets

(b)

(a)

RAPID DEPLOYABLE STRUCTURE FOR REMOTE INSTALLATION

FIELD OF THE INVENTION

The invention relates generally to systems and methods for rapid construction of structures, for example, towers for mounting radio antennas, and particularly, to rapid construction of towers for mounting antennas in remote, difficult to access locations.

BACKGROUND OF THE INVENTION

Conventional antenna towers include a single vertical mast on the order of several hundred feet, on which one or more antenna elements are mounted. The single vertical mast is anchored by a footer of reinforced concrete and one or more guy wires attached to the mast at varying vertical heights and anchored to guy wire footers disposed radially around the base of the antenna. The antenna elements are electrically coupled to one or more transceivers, which are located proximate to the antenna masts' base, or remotely.

Antenna mast sections are typically arranged as three long, narrow, planar, rectangular members connected to one another at approximately 60 degrees to form a triangular cross section. Each long, narrow, planar, rectangular is defined by two long parallel beams mutually connected by angled braces. This conventional antenna tower configuration yields an acceptably rigid tower with a minimal amount of material, but requires stabilization by guy wires having a relatively wide footprint, i.e., having guy wire anchors that are disposed relatively far from the mast itself. Where shorter antenna heights are acceptable, conventional antenna towers are constructed as free standing assemblies with a square cross sections that taper from a wide base to a relatively narrow top. In these cases, the tower typically has four footers anchoring each corner of the tower, and guy wires are unnecessary. FIG. 1 shows two examples of prior art antenna towers.

FIG. 1(*a*) shows a single-mast type conventional antenna tower. The conventional single mast tower of antenna of FIG. 1(*a*) includes a footer 105 that anchors the antenna mast. One or more mast sections 110 are mutually vertically connected and anchored to footer 105. Mast sections 110 are conventionally triangular or rectangular in cross section and formed of a plurality of vertically arranged beams 112 with angled cross braces 114. The antenna tower of FIG. 1(*a*) includes one or more antenna elements 115. Antenna elements 115 are electrically coupled to a transmitter, receiver, or transceiver by a cable, not shown. The antenna tower of FIG. 1(*a*) also conventionally includes lightning arresting structures and aircraft warning lamps, not shown. The antenna tower of FIG. 1(*a*) includes one or more guy wires 120 that provide lateral stability to the antenna and are anchored to guy wire footers, not shown.

FIG. 1(*b*) shows a conventional free standing antenna tower. The antenna tower of FIG. 1(*b*) includes a plurality of footers 130, typically disposed at the four corners of the antenna tower. The antenna tower of FIG. 1(*b*) is constructed of a plurality of tapering mast sections 135, each of which has a rectangular cross section and is formed of a plurality of substantially vertical but non-parallel beams 132, mutually connected by a plurality of cross braces 134. The antenna tower of FIG. 1(*b*) includes one or more antenna elements 140. Antenna elements 140 are electrically coupled to a transmitter, receiver, or transceiver by a cable, not shown. The antenna tower of FIG. 1(*b*) also conventionally includes lightning arresting structures and aircraft warning lamps, not shown.

Conventionally, single mast antenna towers are raised in phases by sequentially installing relatively short mast sections, which are sequentially anchored to guy lines as they are put into place. Typically, the antennal mast footer is poured. Next, a mast section is installed into the footer, typically with the assistance of a mobile crane. Successive mast sections are then attached to the previous mast sections and are periodically secured with radial connections to guy wires anchored to pre-poured guy wire footers until the desired height is achieved. Antenna elements, electrical signal cables to the antenna elements, lighting arresting devices, and aircraft warming lamps are typically installed last, or are pre-installed on the appropriate mast sections prior to the mast sections being installed on the tower.

Conventional antenna tower assemblies are poorly suited for remote installation locations, which are characterized by a number of challenging factors. First, remote installation locations tend to be difficult to access by road, which limits the options available for transporting material to the site. Material and manpower for remote tower construction often must be transported by air, or even by beasts of burden in extreme cases. When there is road access, the quality of the roads often limits them to light vehicles, jeeps, HUMVEES, light trucks, etc., which eliminates the possibility of using most mobile cranes for assembly. Additionally, the work site is generally small, e.g., a rocky outcropping on top of a hill, so the number of workers that can be on-site to assist in tower assembly is small.

Remote worksites pose other unique challenges as well. For example, the soil may be extremely shallow and/or rocky, which makes conventional installation of guy wire footings, which require poured concrete to a depth of several feet, difficult or impossible. The difficulty of installing conventional footings has two disadvantageous impacts. First, without conventional footings achieving the necessary mechanical strength of a guy wire anchor is difficult. Second, conventional towers are usually grounded through guy wire footings, i.e., the conductive paths from lighting arrestors are directed through the footings and into the ground. Without the ability to install a conventional footing, the problem remains regarding how to direct the current associated with lighting strikes.

Additionally, remote sites, such as rocky promontories are generally poorly suited for conventional placement of guy wire supports. This is so because conventional guy wire installation requires a relatively large flat area around an antenna to anchor the guy wires. Such as large flat area is not available if a structure such as an antenna tower is to be installed on a rocky promontory.

SUMMARY OF THE INVENTION

The present invention relates to systems and methods for performing rapid installation of structures, for example antenna towers, on remote sites. Assembly of tower components according to embodiments of the invention is performed by helicopter. The helicopter positions pre-assembled horizontal structural assemblies over vertical antenna tower components. The horizontal assemblies include apertures. The vertical antenna tower components include vertical guiding structures which may be conical or pyramidal such that their cross section increases in size from an upper end to a lower end of the guiding section. The apertures in the horizontal assemblies are arranged and sized such that they fit over the conical or pyramidal guiding structures and are guided into their final lateral positions as they slip down over the guiding structures.

Additional advantageous embodiments of antennas and systems according to the invention are provided. Embodiments of the invention include guy wire anchors formed from cruciform metal structures, rather than conventional poured concreted cylinders. Additionally, electrical grounding is provided by buried ground straps in conductive communication with the surrounding soil through highly conductive soil additives, rather than through guy wire footers.

In one embodiment, a rapidly deployable structure for remote installation is provided. The structure includes a plurality of vertical support columns having a top and bottom end, and a plurality of guiding structures, with each guiding structure disposed on a top end of a vertical support column. Each guiding structure includes a narrow top end, and each guiding structure flares toward a comparatively wider bottom end. The structure also includes at least one horizontal member having an aperture disposed therein adapted to interface with the plurality of guiding structures.

In another embodiment, the guiding structures comprise a plurality of angled guide rails, joined at the narrow top. In another embodiment, the plurality of guide rails comprises four guide rails with a first and second guide rail oriented to form two legs of a first triangular shape having a vertex at the narrow top end of the guiding structure, and a third and fourth guide rail oriented to form two legs of a second triangular shape having a vertex at the narrow top end of the guiding structure.

In another embodiment, the first triangular shape and the second triangular shape are oriented orthogonally to one another. In another embodiment, the first triangular shape has a first base connecting the two legs, the second triangular shape has a second base connecting the two legs, and the first and second bases are substantially co-planar. In another embodiment, the first and the second bases are of unequal lengths.

In another embodiment, the guiding structures are pyramidal in shape. In another embodiment, the guiding structures are conical in shape. In alternative embodiments, the aperture in the horizontal member is substantially rectangular in shape. According to another embodiment, the horizontal member comprises four linear sections joined together in a substantially rectangular shape, and wherein the apertures are located at the corners of the substantially rectangular shape.

In other embodiments, the guiding structure includes a horizontal plate defining an aperture of appropriate size to receive a vertical support column, a plurality of lateral rails connected to the horizontal plate extending away from the horizontal plate along a long axis, and a cross-member connecting the plurality of lateral rails. The guide structure also includes a plurality of wing plates extending laterally away from the horizontal plate along a short axis, a plurality of angled guide rails extending up from the lateral wings, at least one angled guide rail extending up from the horizontal plate, and at least one angled guide rail extending up from the cross member. In certain embodiments, all the guide rails terminate in a vertex section located above and centered on the aperture in the horizontal plate.

Certain embodiments include a method of constructing a rapidly deployable structure. The method involves providing at least one vertical support column having a lower and an upper end and temporarily installing a guiding structure on the upper end of the at least one support column. The guiding structure includes a plurality of angled guide rails terminating in a vertex at an upper end of the guiding structure, and each angled guide rail is angled downwardly away from the vertex.

Certain embodiments include providing a horizontal member having at least one aperture adapted to fit over the guiding structures, coarsely aligning the aperture laterally with the guiding structure, lowering the horizontal member over the guiding structure until the horizontal member reaches a desired vertical position, securing the horizontal member to one of the plurality of vertical support columns, and removing the guiding structure.

In certain embodiments, the plurality of angled guide rails include four guide rails with a first and second guide rail oriented to form two legs of a first triangular shape having vertex at an upper end of the guiding structure, and a third and fourth guide rail oriented to form two legs of a second triangular shape having a vertex at the upper end of the guiding structure. In certain embodiments, the first triangular shape and the second triangular shape are oriented orthogonally to one another. In some embodiments, the first triangular shape has a first base connecting the two legs, the second triangular shape has a second base connecting the two legs, and the first and second bases are substantially co-planar. In certain embodiments, the first and second bases are of unequal lengths, and the aperture is substantially rectangular in shape. In some embodiments, horizontal member is lowered into position using a helicopter.

Embodiments of the invention have certain distinct advantages over conventional systems. Significantly, embodiments of the invention allow for helicopter assembly of tower sections without the need for land mobile cranes or workers on the ground. Helicopter assembly allows for structures to be constructed not only in remote, difficult to access locales, but also allows for construction to occur much faster than with conventional structures. Since structures according to the embodiments of the invention are semi-free standing, they can be installed with a smaller overall footprint than conventional single-mast antenna towers. Additionally, embodiments of the invention allow for the anchoring and grounding of guy wires in remote areas, i.e., areas with shallow rocky soil. Other advantages will become clear through review of the following detailed description.

DETAILED DESCRIPTION OF THE PREFERRED EMBODIMENTS

This invention is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
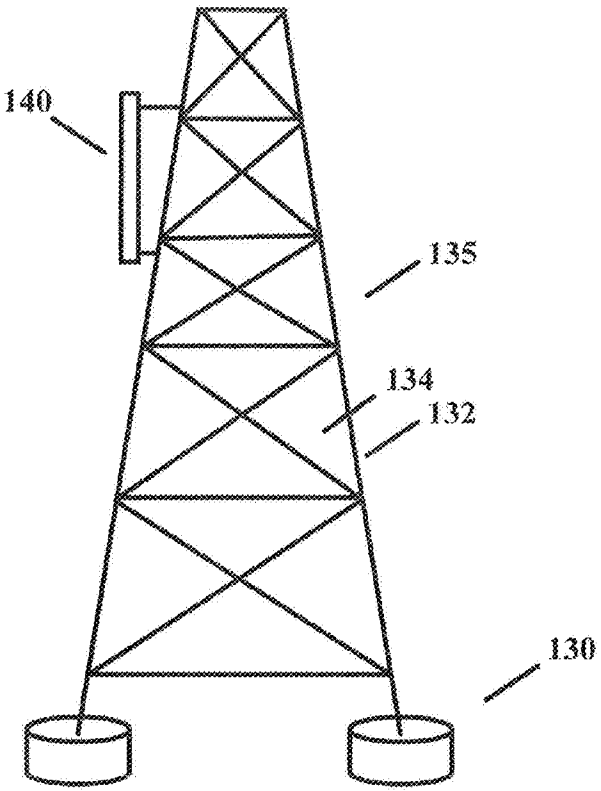
Fig. 1 (Prior Art)
FIGS. 1*a* and 1*b* are schematic diagrams of conventional antenna structures.
Figure 1:
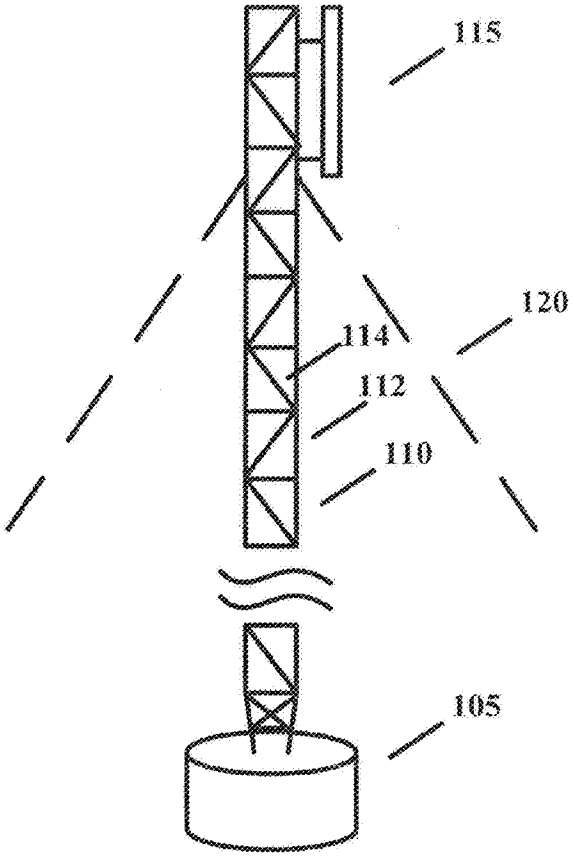
Fig. 1 (Prior Art)
Figure 2:
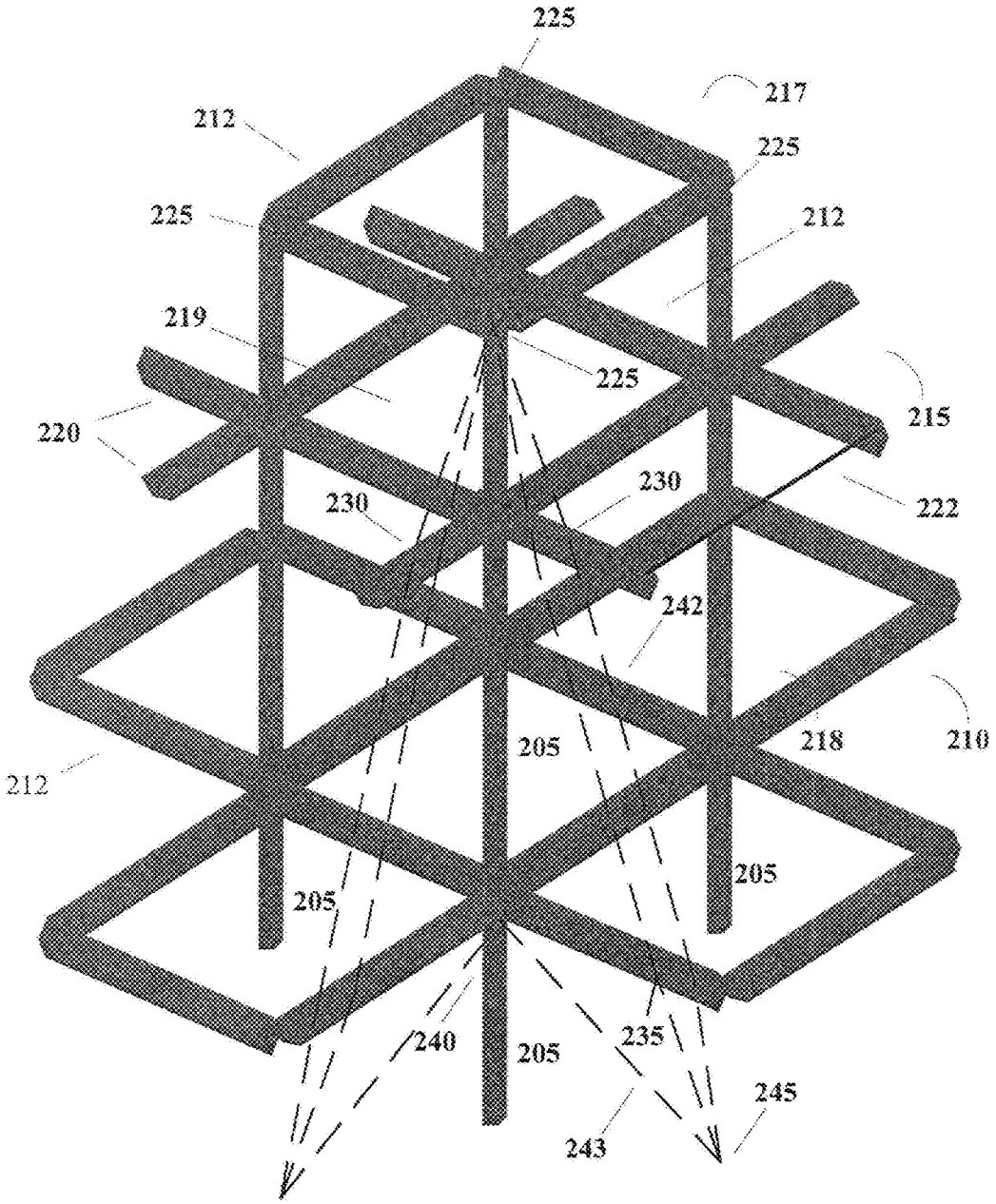
FIG. 2 is a schematic diagram of a rapidly deployable structure according to an embodiment of the invention.

FIG. 2 is a schematic diagram showing the geometry of a rapidly deployable structure according an embodiment of the present invention. The structure of FIG. 2 includes four vertical support columns 205. Each of vertical support columns 205 has a substantially square cross section and is constructed of structural steel. Vertical support columns 205 are anchored by non-illustrated poured concrete footings located below vertical support columns 205 to a depth of several feet in the ground. Vertical support columns 205 are optionally constructed from a plurality of shorter vertical members, which are assembled on-site to achieve the necessary overall height for each vertical support member 205.

The structure of FIG. 2 generally includes 3 levels: a first level 210, a second level 215 and a third level 217. Each level is constructed of a plurality of horizontal structural members, e.g., 212, which are secured to one another and secured to the vertical columns 205.

In the first level 210, sixteen horizontal members 212 are arranged to define four substantially square apertures 218 that are disposed radially around a square defined by the vertical support columns 205 and extend outwardly from a square defined by the vertical support columns 205. In certain embodiments groups of four horizontal members 212 are pre-assembled into squares before being attached to vertical support columns 205.

In the second level 215, four horizontal members 212 are arranged to define a square 219. The corners of square 219 are attached to vertical support columns 205. The second level 215 also includes eight horizontal extensions 220 that continue the edges of square 219 out and away from vertical support columns 210 that define square 219. Pairs of horizontal extensions 220 are tied together with stiffening braces 222 in certain embodiments. In one embodiment, two stiffening braces 222 (only one of which is illustrated) are used for each pair of horizontal extensions 220.

The third level 217 includes four horizontal members 212 that are also arranged to define a square including vertical support columns 205.

Third level 217 includes four guy wire anchor points 225 arranged near the junction between vertical support columns 205 and horizontal members 212. Two pairs of guy wires (each pair denoted by reference numeral 242) are anchored at each guy wire anchor point 225. Only two pairs of guy wires 242 are shown for clarity. Each pair of guy wires 242 extends downwardly at an angle away from anchor point 225 toward ground anchor point 245. At ground anchor point 245 is an anchor assembly, for example, the assembly described below with respect to FIG. 7. Each pair of guy wires 242 is also connected first to the horizontal extensions 220 at anchor points 230, and then to the horizontal members 212 on the first level 210 of the structure at anchor points 235. This arrangement provides additional support for the horizontal structures on the first 210 and second 215 levels extending outwardly and away from vertical support columns 205.

Eight additional guy wires 243 are anchored at anchor points 240 arranged near the junction between vertical support columns 205 and horizontal members 212 on the first level 210. These guy wires 243 extend downwardly and away from the structure of FIG. 2 to ground anchor points 245.

Figure 3:
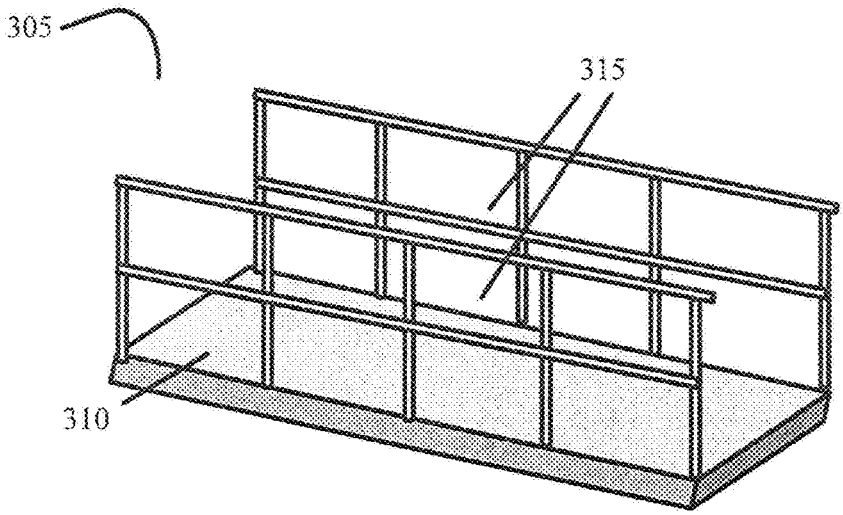
FIG. 3 is a schematic diagram of a horizontal structural member for a rapidly deployable structure according to an embodiment of the invention.

FIG. 3 shows a close-up schematic diagram of a horizontal member according to an embodiment of the invention, for example, a horizontal member 212 described above with respect to FIG. 2. Horizontal member 305 includes a catwalk floor section 310 with sufficient strength to support foot traffic, that are OSHA compliant, and conform to CFR 29 Parts 1900 through 1910 and pertinent ANSI and ASME specifications. Horizontal member 305 also includes railing sections 315. In addition to safety functions, railing sections 315 provide anchor points for a variety of hardware to be installed on the structure, for example, broadcast or receive antennas (not shown).

Figure 4:
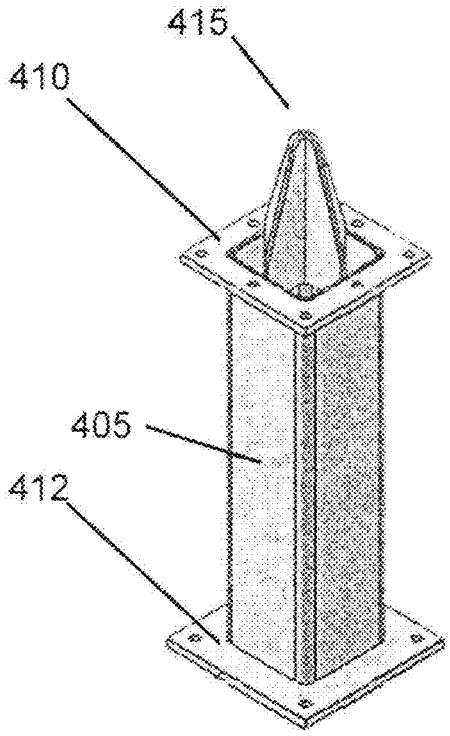
FIG. 4 is a schematic diagram of a vertical column section for a rapidly deployable structure according to an embodiment of the invention.

FIG. 4 shows a section of a vertical support column section for a structure according to an embodiment of the invention. Multiple vertical support column sections of the type illustrated in FIG. 4 may be used according to embodiments of the invention to construct, for example, the vertical support columns 205 discussed above with respect to FIG. 2. The vertical support column section of FIG. 4 includes a shaft 405 of tubular structural steel having a substantially square cross section. At each end of shaft 405 are an upper flange 410 and a lower flange 412 to allow multiple support column sections to be mated together to form a support column, for example, the vertical support columns 205 discussed above with respect to FIG. 2. At the upper end of the vertical support column section of FIG. 3, a column guide 415 is disposed within the perimeter defined by the upper flange 410. Column guide 415 is constructed of a plurality of planar sections of steel that define fins. The overall arrangement of the fins of the column guide 415 defines a substantially conical 3-dimensional shape that tapers from the lower end of the column guide 415 to the upper end of the column guide. When viewed as a 2-d projection, the column guide appears to be substantially triangular, which again, reflects the tapering of the column guide from the lower to upper end.

During assembly of multiple vertical column sections into a larger vertical support column, column guide 415 interfaces with the interior of the square tubular steel shaft of the next vertical column section to be assembled. Column guide 415 allows the next column section to be coarsely aligned laterally with the column section preceding it before the next column section is lowered onto the column section preceding it. As the next column section is lowered, the column guide 415 laterally guides the next column into position until the upper flange 410 mates with the lower flange 412 of the next column. Once the next column is in position, it can be attached to the preceding column via fasteners installed through mating through holes in the flanges.

Figure 5:
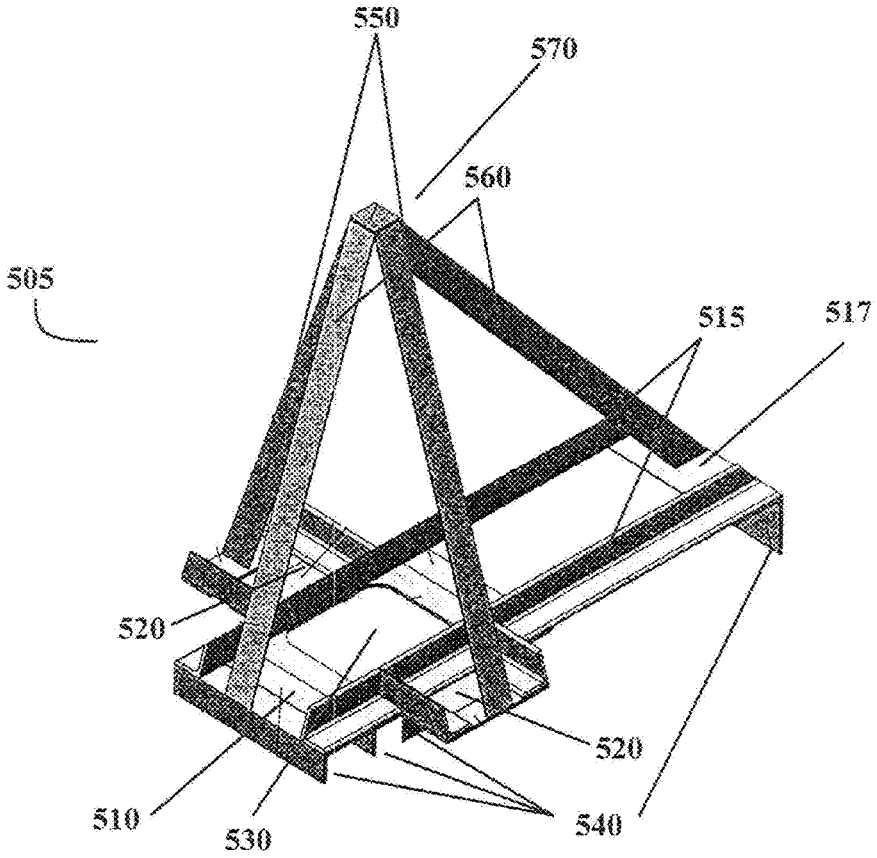
FIG. 5 is a schematic diagram of a horizontal member guide for rapidly deployable structure according to an embodiment of the invention.

FIG. 5 shows a schematic diagram of a horizontal member guide according to the invention. Horizontal member guide 505 is installed on a vertical column section intended to interface with a horizontal member. For example, in FIG. 2 discussed above, horizontal member guide 505 would be temporarily installed at the upper end of a vertical column section near guy wire anchor point 225 prior to attaching a horizontal member 212 to the vertical column section. In certain embodiments, the vertical column section on which horizontal member guide 505 would be installed would lack a column guide 415 since that vertical column section would be mating to a horizontal member rather than directly to another vertical column section. In other embodiments of the invention, the horizontal member guide 505 is temporarily installed onto a vertical column section that includes a column guide.

Horizontal member guide includes a horizontal plate 510, which is substantially rectangular in shape having a long axis and a short axis. Horizontal plate 510 defines an aperture 530 which fits around a vertical column section when horizontal member guide 505 is installed. A plurality of horizontal beams 515 are attached to the upper surface of horizontal plate 510 and extend away from horizontal plate 510 along the long axis defined by horizontal plate 510. Horizontal beams 515 are joined by a cross-member 517. Two wing plates 520 are disposed to either side of horizontal plate 510 parallel to the short axis defined by horizontal plate 510. Wing plates 520, horizontal plate 510 and horizontal beams 515 defined a substantially cruciform structure having a short dimension, defined by wing plates 520 and a long dimension defined by horizontal plate 510 and beams 515. This cruciform structure includes a plurality of stiffening plates 540 arranged as shown in one embodiment.

Horizontal member guide 505 includes a pair of long axis guide rails 560 and a pair of short axis guide rails 550. Long axis guide rails 560 and short axis guide rails 550 together form a pyramidal structure, having two triangular two dimensional cross sections for cross sections taken along the short and long axes of the cruciform structure. The pyramidal structure flares from a narrow vertex 570 to a substantially rectangular base defined by the intersection of the guild rails 550, 560 with the cruciform structure defined by wing plates 520, horizontal plate 510 and horizontal beams 515.

The purpose of the pyramidally arranged guide rails 550, 560 is to interface with an aperture disposed in a horizontal member, for example, horizontal member 212 described above with respect to FIG. 2 (or assemblies of horizontal members) to allow for horizontal members (or assemblies of horizontal members) to be coarsely laterally aligned with vertical support column section. After course alignment, the apertures in the horizontal members (or assemblies thereof) can be dropped over guide rails 550, 560, where guide rails 550, 560 guide the horizontal member laterally into place as it moves vertically into its final installed position. After the horizontal member (or an assembly thereof) has been secured to a vertical column section, the horizontal member guide 505 can be removed from the vertical column.

Although the horizontal member guide 505 described above includes a tapering section composed of four guide rails arranged to form a pyramidal structure, many other shapes are possible. For example, the horizontal member guiding elements could be solid plates arranged in a pyramid, rather than rails. The horizontal member guide could be conical in shape, rather than pyramidal, for example, having the shape of column guide 415 set forth above with respect to FIG. 4. Additionally, there is no requirement that the tapering shape of the horizontal member guide have a long axis and a short axis, i.e., in the case where the tapering guiding shape is pyramidal, the base of the pyramidal shape could be square rather than rectangular. Additionally, while the example of FIG. 5 includes two pairs of guide rails arranged in a cruciform pattern, this is not a requirement. A single pair of guild rails that provides lateral alignment only along a single axis is within the scope of embodiments of the invention. The only requirement for a horizontal member guides according to embodiments of the invention is that they flare from a narrow upper section to a wide lower section so that, when a horizontal member is lowered onto the guide, the guide interfaces with a surface on the horizontal member (e.g., an aperture) to laterally align the horizontal member as it is lowered into its final position.

Figure 6A:
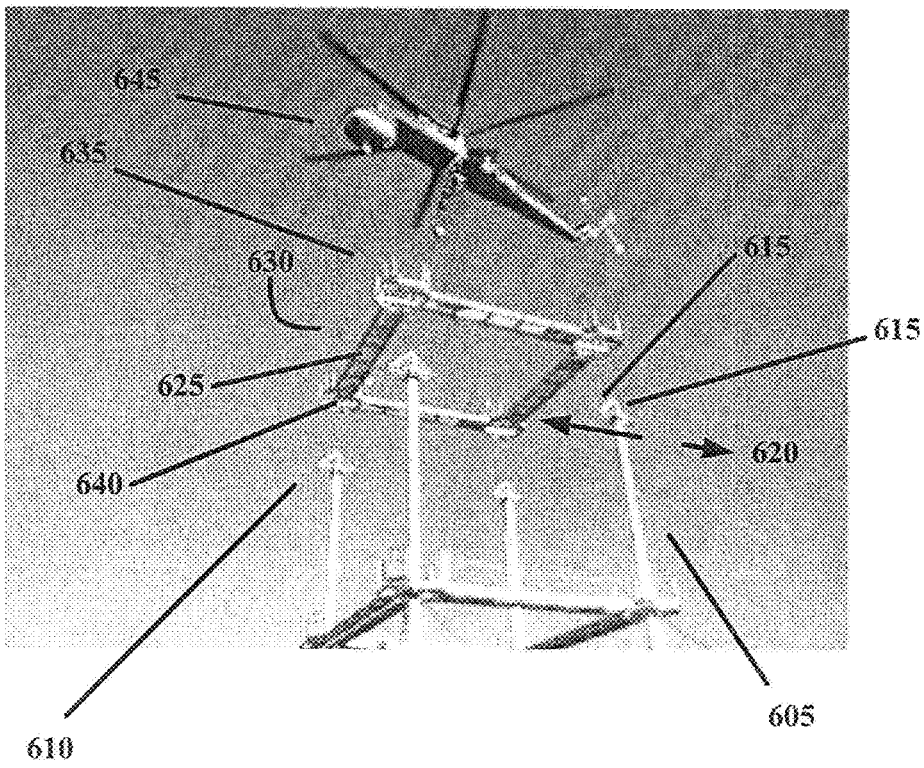
FIG. 6*a* is a schematic diagram of a rapidly deployable structure according to an embodiment of the invention in the process of assembly.

FIG. 6*a* shows a rapidly deployable structure according to an embodiment of invention in the process of being assembled. The structure of FIG. 6 includes a plurality of vertical support columns 605. Each vertical support column 605 includes a temporarily installed guide structure 610. Each guide structure 610 includes at least two guide rails 615, which are joined at an apex. Guide rails 615 are arranged to substantially define a triangle disposed along the axis 620 indicated. The structure of FIG. 6 also includes a horizontal assembly 630, which in this case, is formed of four horizontal members 625 pre-assembled into a square shape. The corners of the horizontal assembly 630 include platforms 635, which are substantially circular in shape. Each platform 635 defines a rectangular aperture 640 of a size and shape appropriate to interface with guide structures 610. As horizontal assembly 630 is lowered over the vertical support columns 605, guide structures 610 interface with the interior surfaces of apertures 640, which guides horizontal assembly 630 into place laterally, for example along axis 620, as horizontal assembly 630 is lowered into its final assembled position. Lowering and coarse positioning of horizontal assembly 630 is performed with a helicopter 645 in the example of FIG. 6, but other assembly tools are usable, for example cranes or block-and-tackle systems. The arrangement of FIG. 6 allows assembly to be performed completely from the air, with no personnel on the ground needed to laterally align horizontal assembly 630 as it is lowered into place.

Figure 6B:
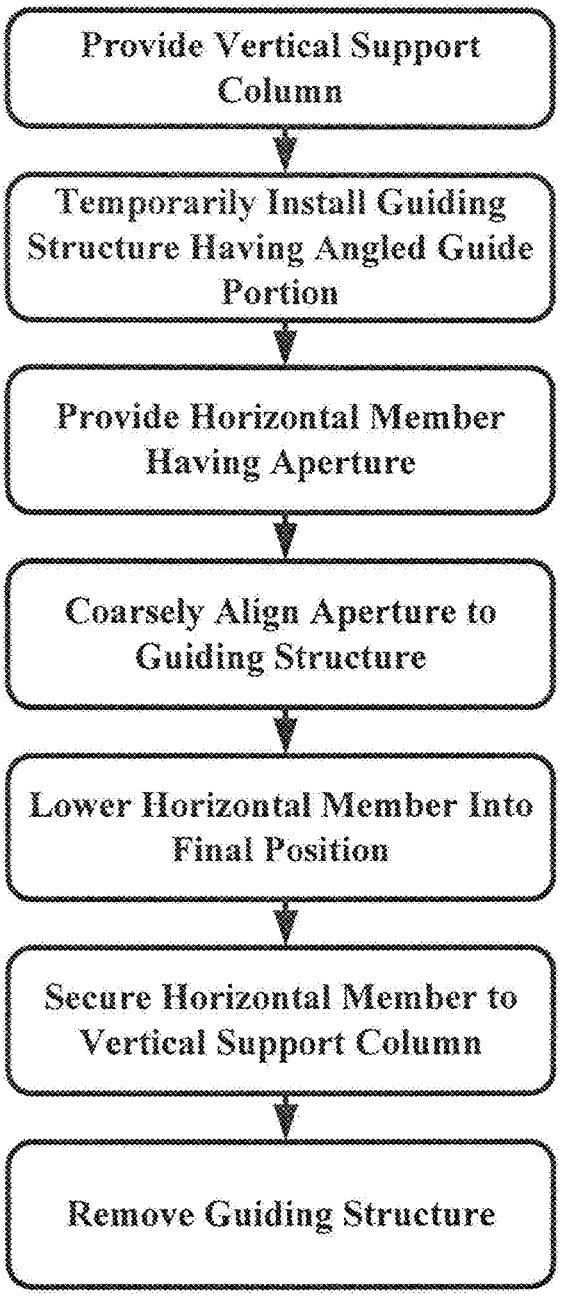
FIG. 6*b* is a flow chart showing the steps of constructing a rapidly deployable structure according to an embodiment of the invention.

Certain assembly process steps discussed above are illustrated in additional detail in FIG. 6*b*, which is a flowchart showing a method of assembling a rapidly deployable structure according to the present invention. In the example of FIG. 6*b*, the guide is referred to as an angled guiding portion. It is important to note that the scope of the invention includes any guiding structure that is disposed at an angle such that when a horizontal member is lowered onto the guide, the guiding structure interfaces with a surface on the horizontal member (e.g., an aperture) to laterally align the horizontal member as it is lowered into its final position.

Figure 7:
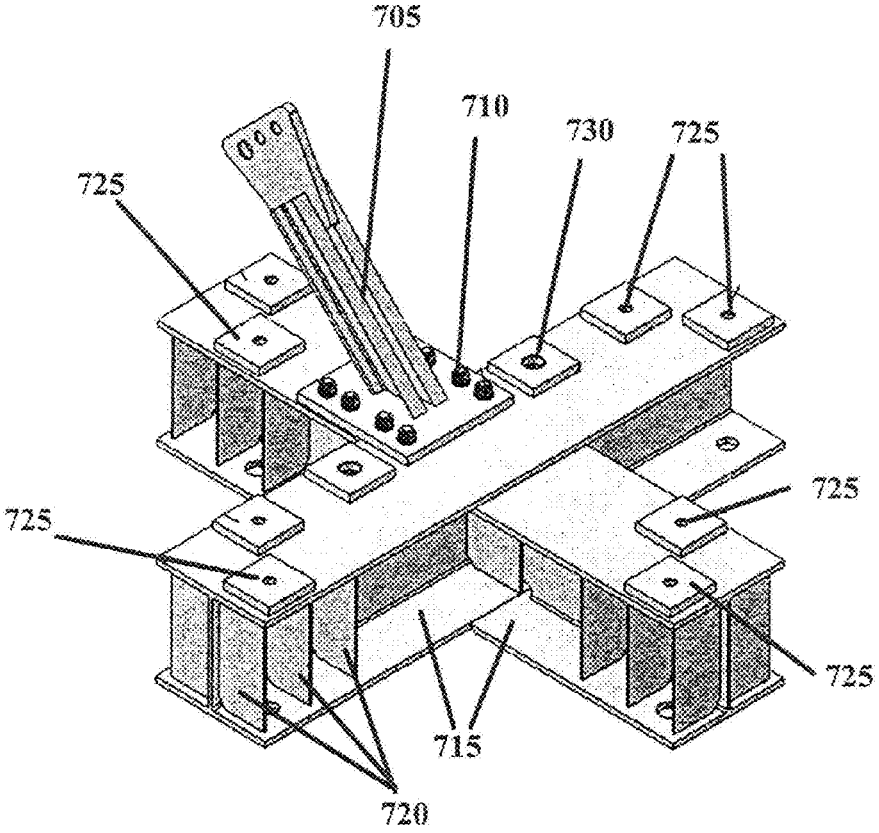
FIG. 7 is a schematic diagram of a guy-wire anchor assembly for a rapidly deployable structure according to an embodiment of the invention.

FIG. 7 shows a guy wire anchor assembly according to an embodiment of the invention. In the anchor assembly of FIG. 7, a guy anchor 705 including a guy anchor base 710. Guy anchor 705 is connected to one or more guy wires, not shown. Guy anchor base 705 is connected, e.g., by welding or by the use of fasteners as shown, to a cruciform anchor defined by a pair of crossed steel I-beams 715. I-beams 715 include a plurality of stiffeners 720 that provide additional structural rigidity. I-beams 715 define a plurality of anchor pin through holes 725, about which are included washer plates. Anchor pin through holes 725 accept non-illustrated anchor pins, which are driven into rock or soil underlying the anchor assembly of FIG. 7. I-beams 715 also define grounding pin through holes 730, which accept electrical grounding pins, not shown. The electrical grounding pins are described in more detail below with respect to FIG. 8.

Because of the substantial amount of exposed metal used to construct the structure of FIG. 2, and because the structure of FIG. 2 may, in certain embodiments, be installed on a vertically projecting terrain feature such as a hill, grounding of lightning strikes is of particular concern. As is set forth above in the Background of the Invention, conventional antenna towers are typically grounded though the concrete footers for guy wires and for the tower itself. Since poured concrete footers for guy anchors may be impracticable in certain installation scenarios, the cruciform guy wire anchors, which are bolted directly to rock or soil, are suggested in certain embodiments for use as a replacement for concrete guy wire footers. The use of such anchors benefits from a grounding arrangement such as is described in reference to FIG. 8.

Figure 8:
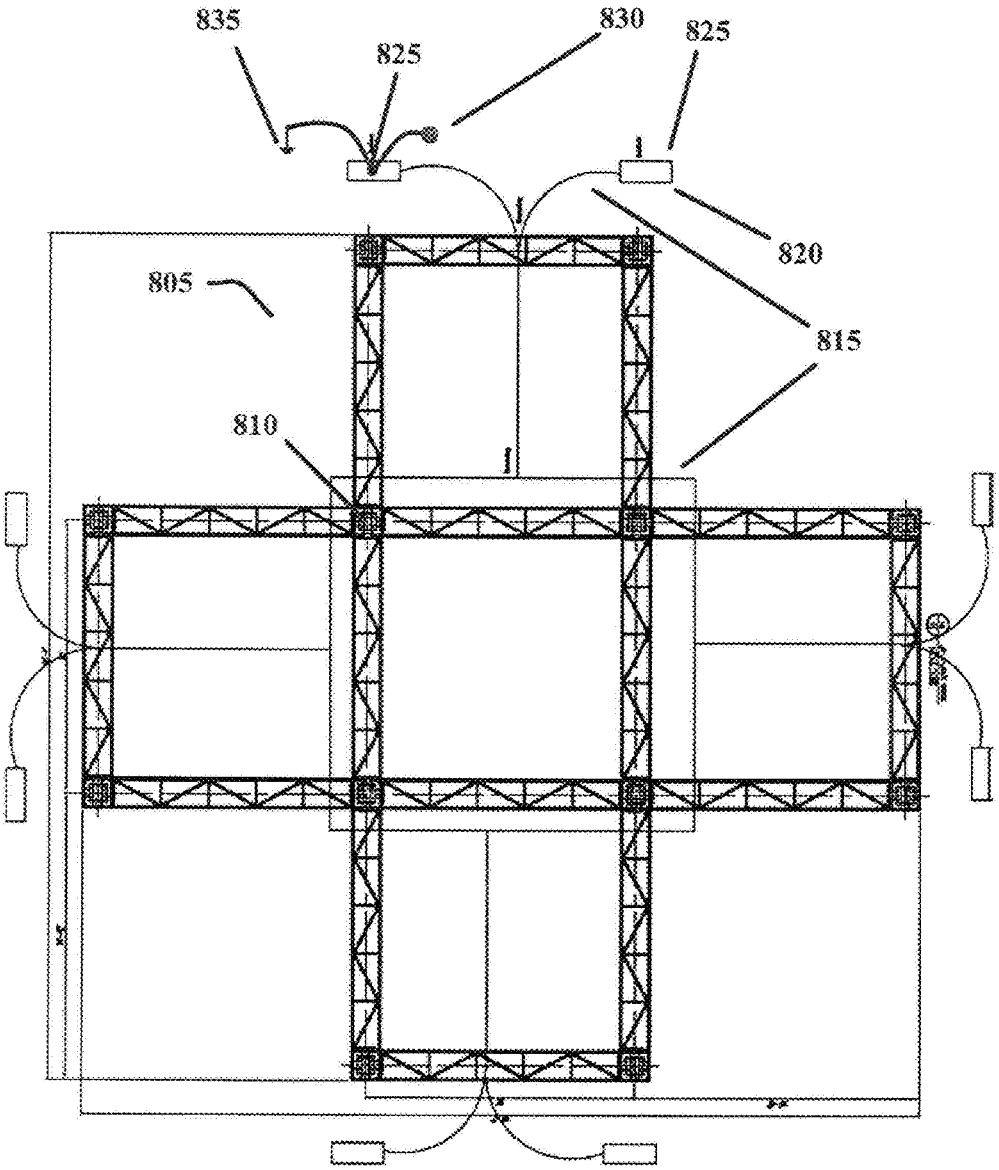
FIG. 8 is a top-down schematic view of a rapidly deployable structure according to an embodiment of the invention showing an arrangement of electrical grounding elements.

FIG. 8 is a top down view of a rapidly deployable structure, e.g., the structure described above with respect to FIG. 2, showing an arrangement for electrical grounding according to an embodiment of the invention. FIG. 8 includes a rapidly deployable structure 805, for example, the structure described above with respect to FIG. 2. Structure 805 is anchored by four concrete footers 810. Each concrete footer 810 is conductively coupled at an attachment point 815 to a ground plane assembly 815. The ground plane assembly 815 comprises a buried 1/0 gauge bare copper cable, disposed along the dashed line in FIG. 8, surrounded by a soil conductivity enhancing material, for example Terrafill Soil Enhancement.

Additional grounding is provided through the guy wire anchors. In the arrangement of FIG. 8, a plurality of guy wire footers 820 are shown. In some embodiments of the invention, guy wire footers 820 are the cruciform guy wire anchor assemblies described above with respect to FIG. 7, but this is not a requirement. Each guy wire footer 820 includes a guy wire anchor 825, which is conductively coupled to the ground plane assembly 815, as well as a grounding rod 830 and a grounding plate 835. In certain embodiments, grounding rod 830 is an 18 inch conductive rod welded to the guy wire footer 820 that extends into the ground. In certain embodiments, the ground around grounding rod 830 has been enhanced with the inclusion of a soil conductivity enhancing material, for example Terrafill Soil Enhancement. In certain embodiments, grounding plates 835 are 12"×"12 copper plates buried in soil conductivity enhancing material, for example Terrafill Soil Enhancement. In the arrangement of FIG. 8, grounding plates 835 are used not only at the guy wire footers 820, but also at the attachment points 815 between the structure footers 810 and the ground plane assembly 815.

While one or more embodiments of the present invention have been illustrated in detail, the skilled artisan will appreciate that modifications and adaptations to those embodiments may be made without department from the scope of the present invention as set forth in the following claims.

What is claimed is:

1. A rapidly deployable structure for remote installation, comprising: a plurality of vertical support columns having a top and bottom end; a plurality of guiding structures, with each guiding structure disposed on a top end of a vertical support column, wherein each guiding structure includes a narrow top end, and each guiding structure flares toward a comparatively wider bottom end; and at least one horizontal member having at least one aperture disposed therein adapted to interface with said plurality of guiding structures, wherein each of said guiding structures comprise a plurality of angled guide rails, joined at said narrow top, and wherein said plurality of guide rails comprises four guide rails with a first and second guide rail oriented to form two legs of a first triangular shape having a vertex at said narrow top end of said guiding structure, and a third and fourth guide rail oriented to form two legs of a second triangular shape having a vertex at said narrow top end of said guiding structure.

2. The structure of claim 1, wherein said first triangular shape and said second triangular shape are oriented orthogonally to one another.

3. The structure of claim 2, wherein said first triangular shape has a first base connecting said two legs, said second triangular shape has a second base connecting said two legs, and said first and second bases are substantially co-planar.

4. The structure of claim 3, wherein said first and said second bases are of unequal lengths.

5. The structure of claim 1, wherein said guiding structures are pyramidal in shape.

6. The structure of claim 1, wherein said guiding structures are conical in shape.

7. The structure of claim 1, wherein said aperture is substantially rectangular in shape.

8. A rapidly deployable structure for remote installation, comprising:

a plurality of vertical support columns having a top and bottom end;

a plurality of guiding structures, with each guiding structure disposed on a top end of a vertical support column, wherein each guiding structure includes a narrow top end, and each guiding structure flares toward a comparatively wider bottom end; and at least one horizontal member having at least one aperture disposed therein adapted to interface with said plurality of guiding structures, wherein said horizontal member comprises four linear sections joined together in a substantially rectangular shape having four apertures located at the corners of said substantially rectangular shape.

9. A rapidly deployable structure for remote installation, comprising:

a plurality of vertical support columns having a top and bottom end;

a plurality of guiding structures, with each guiding structure disposed on a top end of a vertical support column, wherein each guiding structure includes a narrow top end, and each guiding structure flares toward a comparatively wider bottom end; and at least one horizontal member having at least one aperture disposed therein adapted to interface with said plurality of guiding structures, wherein each of said guiding structure comprises:

a horizontal plate defining an aperture of appropriate size to receive a vertical support column;

a plurality of lateral rails connected to said horizontal plate extending away from said horizontal plate along a long axis;

a cross-member connecting said plurality of lateral rails;

a plurality of wing plates extending laterally away from said horizontal plate along a short axis;

a plurality of angled guide rails extending up from said lateral wings;

at least one angled guide rail extending up from said horizontal plate;

at least one angled guide rail extending up from said cross member;

wherein all said guide rails terminate in a vertex section located above and centered on the aperture in the horizontal plate.

10. A method of constructing a rapidly deployable structure, comprising:

providing a plurality of support column having a lower and an upper end;

temporarily installing a plurality of guiding structures near the upper end of a plurality of vertical support columns, wherein each of the guiding structures includes a plurality of angled guide rails terminating in a vertex at an upper end of said guiding structure, each angled guide rail is angled downwardly away from said vertex, and each of said plurality of angled guide rails comprise four guide rails with a first and second guide rail oriented to form two legs of a first triangular shape terminating at the vertex, and a third and fourth guide rail oriented to form two legs of a second triangular shape terminating at the vertex;

providing a horizontal member having at least one aperture adapted to fit over said guiding structures;

coarsely aligning said at least one aperture laterally with said guiding structure;

lowering said horizontal member over said guiding structure until said horizontal member reaches a desired vertical position;

securing said horizontal member to at least one of said plurality of vertical support columns; and removing the guiding structure.

11. The method of claim 10, wherein said first triangular shape and said second triangular shape are oriented orthogonally to one another.

12. The method of claim 11, wherein said first triangular shape has a first base connecting said two legs, said second triangular shape has a second base connecting said two legs, and said first and second bases are substantially co-planar.

13. The method of claim 12, wherein said first and said second bases are of unequal lengths.

14. The method of claim 10, wherein said aperture is substantially rectangular in shape.

15. The method of claim 10, wherein said horizontal member is lowered into position using a helicopter.

16. The structure of claim 1, wherein at least one guiding structure is removable after the at least one horizontal member is assembled to the plurality of vertical support columns.

17. The structure of claim 9, wherein said angled guide rails are removable after the at least one horizontal member is assembled to the plurality of vertical support columns.

18. The structure of claim 8, wherein said guiding structures are conical in shape.

19. The structure of claim 18, wherein at least one guiding structure is removable after the at least one horizontal member is assembled to the plurality of vertical support columns.

20. A method of constructing a rapidly deployable structure for remote installation, comprising:

providing a plurality of vertical support columns having a top and bottom end;

providing a plurality of guiding structures, with each guiding structure disposed on a top end of a vertical support column, wherein each guiding structure includes a narrow top end, and each guiding structure flares toward a comparatively wider bottom end;

providing at least one horizontal member having at least one aperture disposed therein adapted to interface with said plurality of guiding, wherein said horizontal member comprises four linear sections joined together in a substantially rectangular shape having four apertures located at the corners of said substantially rectangular shape;

coarsely aligning said at least one aperture laterally with said guiding structure;

lowering said horizontal member over said guiding structure until said horizontal member reaches a desired vertical position;

securing said horizontal member to at least one of said plurality of vertical support columns; and removing the guiding structure.

* * * * *